US010512385B2

(12) United States Patent
Tuller et al.

(10) Patent No.: US 10,512,385 B2
(45) Date of Patent: Dec. 24, 2019

(54) GLASSES RACK FOR DISHWASHER

(71) Applicant: WHIRLPOOL CORPORATION, Benton Harbor, MI (US)

(72) Inventors: Barry E. Tuller, Stevensville, MI (US); Steven B. Balinski, Saint Joseph, MI (US); David Jason Brightbill, Benton Harbor, MI (US); Frederick Thomas Roderick, Coloma, MI (US); Joseph T. Ferencevich, Saint Joseph, MI (US); Ryan Kevin Roth, Benton Harbor, MI (US); William J. Snell, Elkhart, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/941,761

(22) Filed: Mar. 30, 2018

(65) Prior Publication Data

US 2018/0220862 A1 Aug. 9, 2018

Related U.S. Application Data

(63) Continuation of application No. 15/416,687, filed on Jan. 26, 2017, now Pat. No. 10,349,804, which is a continuation of application No. 14/620,688, filed on Feb. 12, 2015, now abandoned.

(60) Provisional application No. 61/946,101, filed on Feb. 28, 2014.

(51) Int. Cl.

| | |
|---|---|
| ***A47L 15/14*** | (2006.01) |
| ***A47L 15/00*** | (2006.01) |
| ***A47L 15/50*** | (2006.01) |
| ***A47L 15/42*** | (2006.01) |

(52) U.S. Cl.

CPC ..... *A47L 15/0065* (2013.01); *A47L 15/14* (2013.01); *A47L 15/4285* (2013.01); *A47L 15/50* (2013.01); *A47L 15/508* (2013.01)

(58) Field of Classification Search

CPC ..... A47L 15/50; A47L 15/508; A47L 15/23; A47L 15/22; A47L 15/505

USPC ... 134/170, 56 D, 176, 200, 172, 198, 58 D, 134/135, 179, 57 D, 144, 199, 165, 137, 134/177, 103.2; 211/41.8, 41.9, 41.4, 211/181.1

See application file for complete search history.

(56) References Cited

U.S. PATENT DOCUMENTS

| | | | |
|---|---|---|---|
| 2,646,809 | A | 7/1953 | Van Hise |
| 2,907,470 | A | 10/1959 | Abresch |

(Continued)

FOREIGN PATENT DOCUMENTS

| | | | |
|---|---|---|---|
| DE | 19960496 | A1 | 7/2001 |
| DE | 10332149 | B3 | 5/2005 |

(Continued)

*Primary Examiner* — David G Cormier
*Assistant Examiner* — Thomas Bucci
(74) *Attorney, Agent, or Firm* — McGarry Bair PC

(57) ABSTRACT

A dishwasher can include a tub defining a treating chamber receiving dishes for treatment, a spray system providing treating liquid to the treating chamber, a first dish rack located in the tub and having a bottom wall tiered to form multiple levels defining an effective inclination angle for the bottom wall, and a second dish rack located below the first dish rack and having an inclined non-tiered bottom wall.

21 Claims, 7 Drawing Sheets

(56) References Cited

U.S. PATENT DOCUMENTS

| | | | | |
|---|---|---|---|---|
| 2,910,207 | A * | 10/1959 | Andrew | A47L 15/50 220/488 |
| 3,258,127 | A | 6/1966 | Cushing | |
| 3,464,566 | A | 9/1969 | Gilson | |
| 4,064,887 | A * | 12/1977 | Geiger | A47L 15/23 134/144 |
| 4,134,414 | A | 1/1979 | Jarvis | |
| 6,907,998 | B2 | 6/2005 | Deiss | |
| 7,594,513 | B2 | 9/2009 | VanderRoest et al. | |
| 2003/0192578 | A1* | 10/2003 | Ochoa, Sr. | A47L 15/508 134/176 |
| 2003/0226580 | A1* | 12/2003 | Welch | A47L 15/50 134/172 |
| 2005/0109378 | A1 | 5/2005 | Landsiedel | |
| 2010/0051069 | A1 | 3/2010 | Schessi et al. | |
| 2012/0138106 | A1 | 6/2012 | Fountain et al. | |
| 2012/0292270 | A1 | 11/2012 | Klump | |
| 2013/0002107 | A1 | 1/2013 | Paschini et al. | |
| 2013/0098406 | A1 | 4/2013 | Beshears | |

FOREIGN PATENT DOCUMENTS

| | | | |
|---|---|---|---|
| EP | 2594186 | A1 | 5/2013 |
| JP | 2002065562 | A1 | 3/2002 |
| JP | 5006715 | B2 | 8/2012 |
| JP | 5006716 | | 8/2012 |

* cited by examiner

GLASSES RACK FOR DISHWASHER

CROSS REFERENCE TO RELATED APPLICATIONS

This application is a continuation of U.S. application Ser. No. 15/416,687, filed Jan. 26, 2017, which is a continuation of U.S. application Ser. No. 14/620,688, filed Feb. 12, 2015, entitled "Glasses Rack for Dishwasher," now U.S Pat. No. 10,349,804, issued Jul. 16, 2019, which claims the benefit of U.S. Provisional Patent Application No. 61/946,101, filed Feb. 28, 2014, all of which are incorporated herein by reference in their entirety.

BACKGROUND

Household dishwashers typically include one or more dish racks for holding various types of dishes in the dishwasher tub. Traditionally, a dishwasher includes an upper rack that holds glassware and small dishes, and a lower rack that holds larger dishes, such as plates. These two dish racks usually consume most of the space inside the dishwasher tub. Some dishwashers may also include a third dish rack, often for silverware and other low profile utensils.

SUMMARY

In one aspect, the present disclosure relates to a dishwasher including a tub defining a treating chamber receiving dishes for treatment, a spray system providing treating liquid to the treating chamber, a first dish rack located in the tub and having a bottom wall tiered to form multiple levels defining an effective inclination angle for the bottom wall, and a second dish rack located below the first dish rack and having a non-tiered bottom wall inclined at an angle matching the effective inclination angle and parallel to the first dish rack bottom wall.

In another aspect, the present disclosure relates to a dishwasher including a tub defining a treating chamber receiving dishes for treatment, a spray system providing treating liquid to the treating chamber, and a dish rack located in the tub and having a bottom wall, a side wall extending upwardly from the bottom wall and terminating in an upper edge, with an angled portion formed in the bottom wall, and a spray tube carried by the bottom wall and having nozzles emitting spray along the angled portion.

DESCRIPTION OF EMBODIMENTS OF THE INVENTION

Figure 1:
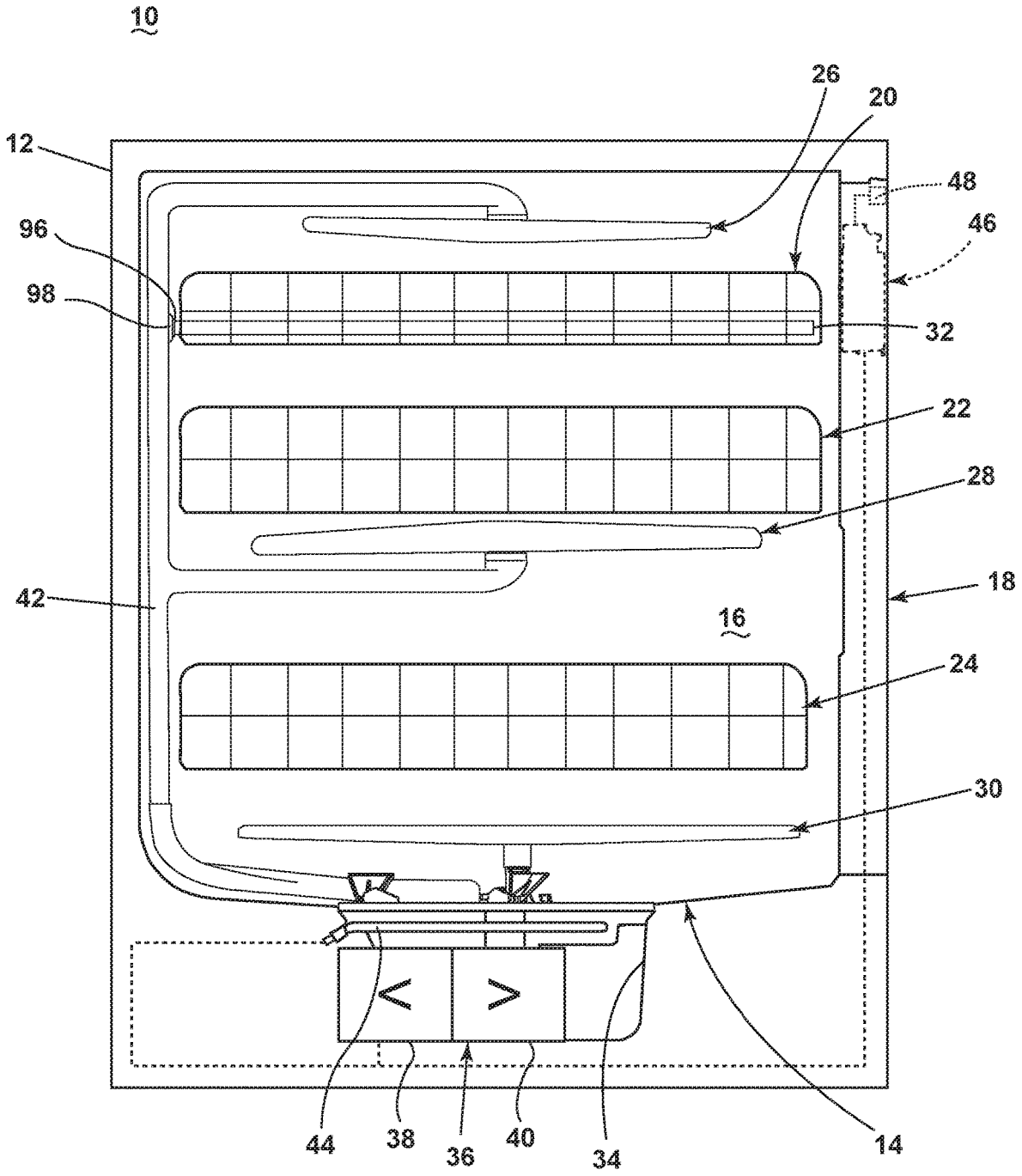
FIG. 1 is a schematic side view of a dishwasher with a glasses dish rack according to one embodiment.

FIG. 1 illustrates a perspective view of an exemplary automated dishwasher 10 according to a first embodiment. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. For built-in dishwashers, outer panels are typically not needed. For dishwashers that are not built into existing cabinetry, the chassis 12 may include the panels mounted to the frame to form a cabinet for the dishwasher 10. An open-faced tub 14 may be provided within the chassis 12 and may at least partially define a treating chamber 16 for washing or otherwise treating dishes. The open face of the tub 14 defines an access opening for the treating chamber 16.

A closure element, such as a door assembly 18, may be movably mounted to the dishwasher 10 for movement between opened and closed positions to selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open. Alternatively, the closure element may be slidable relative to the chassis 12, such as in a drawer-type dishwasher, wherein the access opening for the treating chamber 16 is formed by an open-top tub. Other configurations of the closure element relative to the chassis 12 and the tub 14 are also within the scope of the invention.

Dish holders, illustrated in the form of upper, middle, and lower dish racks 20, 22, 24, may be located within the treating chamber 16 and receive dishes for treatment, such as washing. The upper, middle, and lower racks 20, 22, 24 are typically mounted for slidable movement in and out of the treating chamber 16 for ease of loading and unloading. Other dish holders may be provided, such as a silverware basket, separate from or combined with the upper, middle, and lower racks 20, 22, 24. As used in this description, the term "dish(es)" is intended to be generic to any item, single or plural, that may be treated in the dishwasher 10, including, without limitation, dishes, plates, pots, bowls, pans, glassware, and silverware.

A spray system may be provided for spraying liquid in the treating chamber 16 and may be provided in the form of, for example, an upper spray assembly 26, a middle spray assembly 28, and a lower spray assembly 30. The upper spray assembly 26, the middle spray assembly 28, and the lower spray assembly 30 are located, respectively, above the upper rack assembly 20, beneath the middle rack assembly 22, and beneath the lower rack assembly 24 and are illustrated as rotating spray arms by example but are not limited to such positions and sprayer type. The spray system may further include a rack spray assembly 32 coupled to the upper dish rack 20; the rack spray assembly 32 will be discussed in further detail below. Furthermore, the spray system may include additional and/or alternative spray assemblies. For example, a distribution header or spray manifold may be located at the rear of the tub 14 at any vertical position. An exemplary spray manifold is set forth in detail in U.S. Pat. No. 7,594,513, issued Sep. 29, 2009, and titled "Multiple Wash Zone Dishwasher," which is incorporated herein by reference in its entirety.

A recirculation system may be provided for recirculating liquid from the treating chamber 16 to the spray system. The recirculation system may include a sump 34 and a pump assembly 36. The sump 34 collects the liquid sprayed in the treating chamber 16 and may be formed by a sloped or recess portion of a bottom wall of the tub 14. The pump assembly 36 may include both a drain pump 38 and a recirculation pump 40. The drain pump 38 may draw liquid from the sump 34 and pump the liquid out of the dishwasher 10 to a household drain line (not shown). The recirculation pump 40 may draw liquid from the sump 34, and the liquid may be simultaneously or selectively pumped through a supply conduit or tube 42 to each of the spray assemblies 26, 28, 30, 32 for selective spraying. While not shown, a liquid supply system may include a water supply conduit coupled with a household water supply for supplying water to the treating chamber 16.

A heating system including a heater 44 may be located, for example, within the sump 34 for heating the liquid contained in the sump 34.

A control system including a controller 46 may also be included in the dishwasher 10, which may be operably coupled with various components of the dishwasher 10 to implement a cycle of operation. The controller 46 may be located within the door assembly 18 as illustrated, or it may alternatively be located somewhere within the chassis 12. The controller 46 may also be operably coupled with a control panel or user interface 48 for receiving user-selected inputs and communicating information to the user. The user interface 48 may include operational controls such as dials, lights, switches, and displays enabling a user to input commands, such as a cycle of operation, to the controller 46 and receive information.

Figure 2:
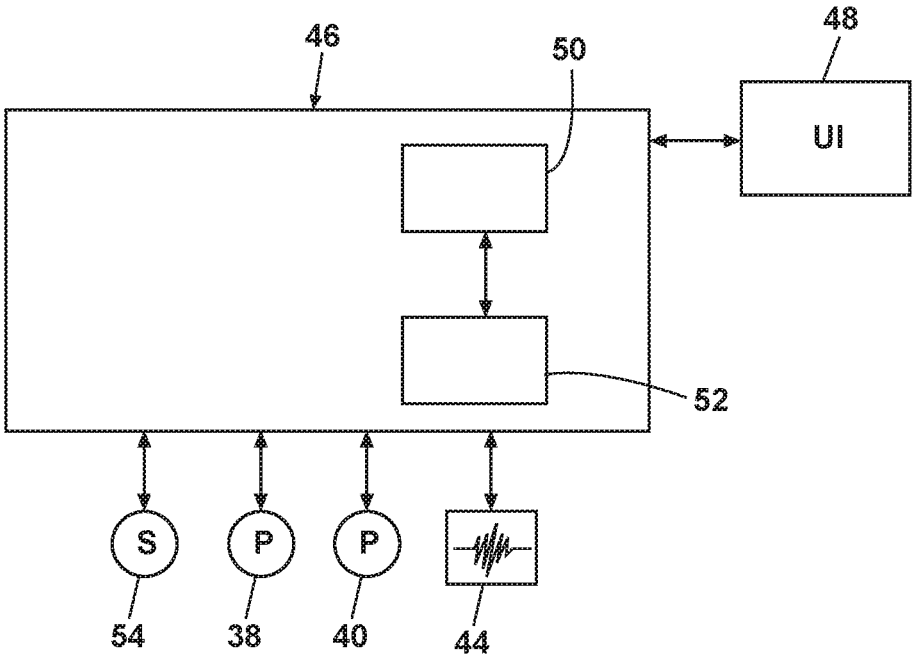
FIG. 2 is a schematic diagram of a control system for the dishwasher of FIG. 1.

As illustrated schematically in FIG. 2, the controller 46 may be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 may be provided with a memory 50 and a central processing unit (CPU) 52. The memory 50 may be used for storing control software that may be executed by the CPU 52 in completing a cycle of operation using the dishwasher 10 and any additional software. For example, the memory 50 may store one or more pre-programmed cycles of operation that may be selected by a user and completed by the dishwasher 10. The controller 46 may also receive input from one or more sensors 54. Non-limiting examples of sensors that may be communicably coupled with the controller 46 include a temperature sensor and turbidity sensor to determine the soil load associated with a selected grouping of dishes, such as the dishes associated with a particular area of the treating chamber 16.

The dishwasher 10 may include all of the above exemplary systems, a selection of the above exemplary systems, and/or other systems not listed above as desired. Further, some of the systems may be combined with other systems and/or may share components with other systems. Examples of other systems that the dishwasher may further include are a dispensing system that supplies one or more treating agents or chemistries to the treating chamber 16 and an air supply system that may provide air, which may be heated or not heated, to the treating chamber 16, such as for drying and/or cooling the dishes. An exemplary air supply system is set forth in U.S. patent application Ser. No. 12/959,673, filed Dec. 3, 2010 and published as U.S. Patent Application Publication No. 2012/0138106 on Jun. 7, 2012, both of which are incorporated herein by reference in their entireties.

Figure 3:
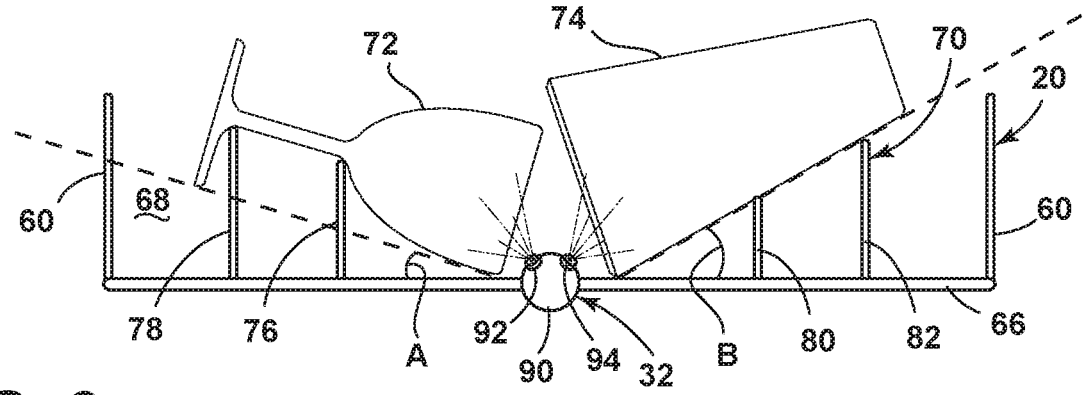
FIG. 3 is a schematic front view of the glasses dish rack of FIG. 1.

Referring now to FIG. 3, the upper dish rack 20 may be particularly configured to hold drinking vessels, such as, for example, tall and short tumblers, including old fashioned glasses, rocks glasses, and highballs, stemware, such as wine glasses, martini glasses, and tulip and saucer champagne glasses, snifters, goblets, bottles, mugs, and the like, which are hereinafter referred to as "glasses" with it being understand that "glasses" includes those exemplary drinking dishes listed above in addition to others not listed herein. Therefore it may be referred to as a dish rack, glasses dish rack, or classes rack and those terms are used interchangeably herein. The glasses may be made of any suitable material, including glass, ceramics, plastic, and metals and are not limited to glass materials. While the glasses dish rack 20 may be located near the top of the tub 14, the glasses dish rack 20 need not be the uppermost dish rack in the tub 14 and is only heretofore referred to as "upper" for convenience.

The glasses dish rack 20 may be constructed of a wire frame effectively forming opposing side walls 60, a front wall 62 (FIG. 4), a rear wall 64 (FIG. 4), and a bottom wall 66 that together define an open-top glasses holding compartment 68. The bottom wall 66 may be completely flat, as illustrated by example, to form a flat bottom dish rack or may have a varied configuration comprising a plurality of inclined and, possibly, flat walls that effectively forms an overall horizontal bottom or an inclined bottom as will be described in more detail below. Additionally, a plurality of glass supports 70, such as a panel, tines, or other structures, may extend upwardly from the bottom wall 66 and/or the side walls 60, the front wall 62, and the rear wall 64 to support various glasses, such as, for example, a wine glass 72 and a tall tumbler 74. If panels are used for forming the glass supports 70, the panels may have through openings for the easy passing of liquid. The glass supports 70 may be configured to position the glasses 72, 74 at angles A, B less than about 45 degrees relative to the horizontal. In this embodiment, the horizontal is about coincident with the bottom wall 66 of the dish rack 20. The angle A, B may be defined as the angle between the side wall of the glass and horizontal. If the side wall of the glass is curved, then the angle may be defined as the angle between a line tangent to the glass side wall and the horizontal. The particular angles A, B at which the glasses 72, 74 are inclined, which may be equal or not equal, are a compromise between (1) the overall height of the dish rack 20 and the portion of the glasses 72, 74 extending above the dish rack 20 and (2) suitable draining of liquid from the interior and exterior surfaces of the glasses 72, 74. As the angles A, B increase to improve draining, the overall height increases, thereby consuming more valuable space within the tub 14. On the other hand, as the angles A, B decrease to reduce height and minimize the space required within the tub 14, draining performance may decrease. Exemplary preferred glass inclination angles range from about 5 to 45 degrees, with a preferred angle being about 15 degrees. The preferred inclination angle may vary for different types of glasses as the draining behavior may differ due to inherent structural differences, such as the contour and inclination of the side wall of the glasses.

Figure 4:
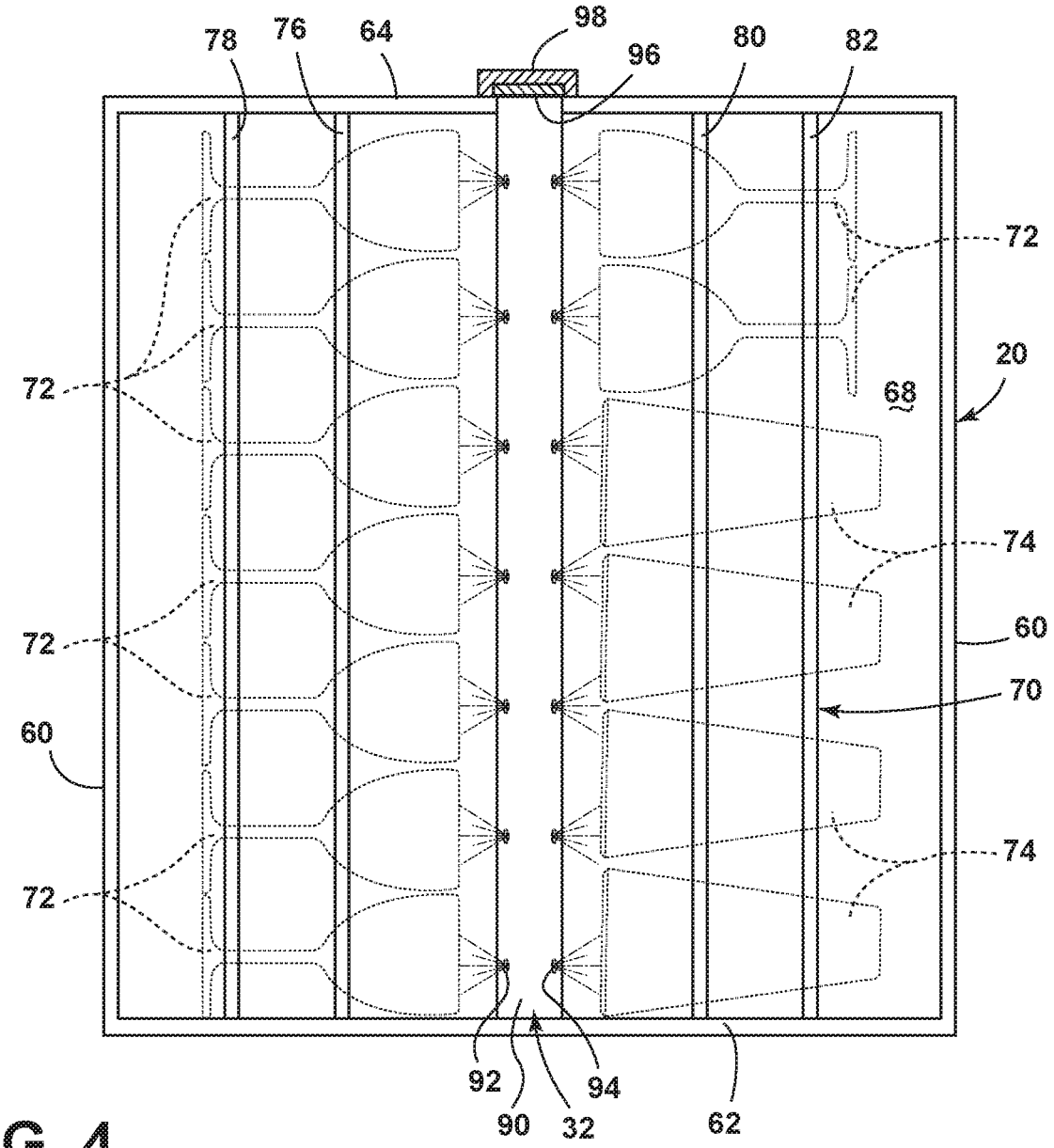
FIG. 4 is a schematic top view of the glasses dish rack of FIG. 1.

To accomplish the inclined positioning in the illustrated exemplary embodiment, the wine glass 72 is supported by a first row of glass supports 76 shorter than a second row of glass supports 78, and the tall tumbler 74 is supported by a third row of glass supports 80 shorter than a fourth row of glass supports 82. Optionally, the glass supports 70 may form a cradle or notch for each of the glasses 72, 74 to retain the glasses 72, 74 in a particular location and prevent the glasses 72, 74 from rolling within the dish rack 20. As seen in FIG. 4, the dish rack 20 may be configured to hold multiple rows of glasses 72, 74, and the illustrated embodiment includes a first row of multiple wine glasses 72 supported by the first and second rows of glass supports 76, 78 and a second row of multiple tall tumblers 74 and multiple wine glasses 72 supported by the third and fourth rows of glass supports 80, 82. The glass supports 70 may be configured to best hold a specific type of glass, such as the wine glasses 72 in the first row, or may be configured to more generically hold multiple types of glasses, such as the wine glasses 72 and the tall tumblers 74 in the second row. The glass supports may be adjustable, which would allow the user to individually place different sized glasses and ensure that the minimum angle needed to drain water from the item is achieved. The glass rack 20 may further be configured to automatically pivot each glass to a desired position.

Optionally, the glasses dish rack 20 may be equipped with the rack spray assembly 32 adapted to provide treating liquid to the interior of the glasses 72, 74. While the glasses 72, 74 may be subjected to the treating liquid provided by the other spray assemblies, such as the upper spray assembly 26 (FIG. 1), the inclined orientation of the glasses 72, 74 faces the openings for the glasses 72, 74 generally downward (i.e., relative to the horizontal) such that the other spray assemblies, such as the upper spray assembly 26 (FIG. 1), may provide an insufficient amount of liquid into the glasses 72, 74 to properly treat the interior of the glasses 72, 74. The rack spray assembly 32 may include any suitable type of sprayer and is shown by example as a stationary spray tube 90 with a first row of spray nozzles 92 facing the first row of glasses and a second row of spray nozzles 94 facing the second row of glasses. The spray nozzles 92, 94 may be positioned to spray treating liquid into the interior of the glasses 72, 74, and the volume and velocity of the treating liquid emitted from the spray nozzles 92, 94 may be set based on the type of glasses, may be generic for all types of glasses, and/or may be variable from one treating cycle of operation to another and/or within a single treating cycle of operation. Additionally, the spray nozzles 92, 94 may spray liquid alternately (e.g., between rows—one row at a time wherein the rows are sequenced on and off, within rows—sets of nozzles within a row sequenced on and off), continuously, and/or intermittently.

The rack spray assembly 32 may be fixedly mounted to the glasses dish rack 20 for movement therewith when the dish rack 20 is slid relative to the tub 14, as illustrated, or the rack spray assembly may be fixedly mounted to the tub 14 so as to retain its position relative to the tub 14 upon movement of the dish rack 20. In the former case, the rack spray assembly 32 may dock with the supply tube 42 (FIG. 1) or other structure of the liquid supply and/or recirculation systems when the glasses dish rack 20 is slid to its most rearward position in the tub 14 to establish fluid communication with the liquid supply and/or recirculation systems. By example, the illustrated rack spray assembly 32 includes a connector 96 located at the rear end of the spray tube 90 and adapted to mate or dock with a receiver 98 in the tub 14. The receiver 98 may be mounted at the rear of the tub 14, such as to the supply tube 42 (FIG. 1), or in any other suitable location.

Figure 5:
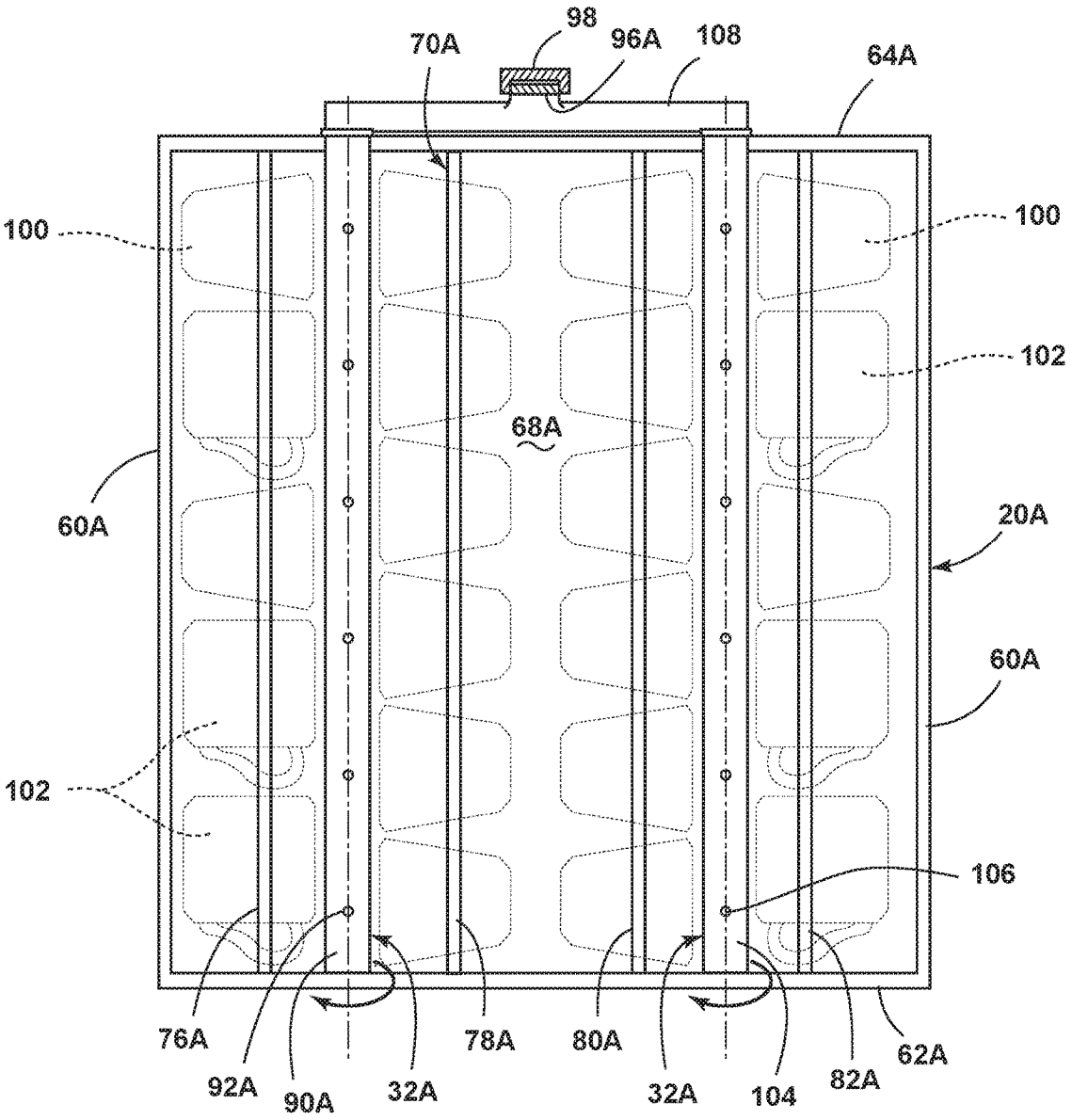
FIG. 5 is a schematic top view of a glasses dish rack according to another embodiment.
Figure 6:
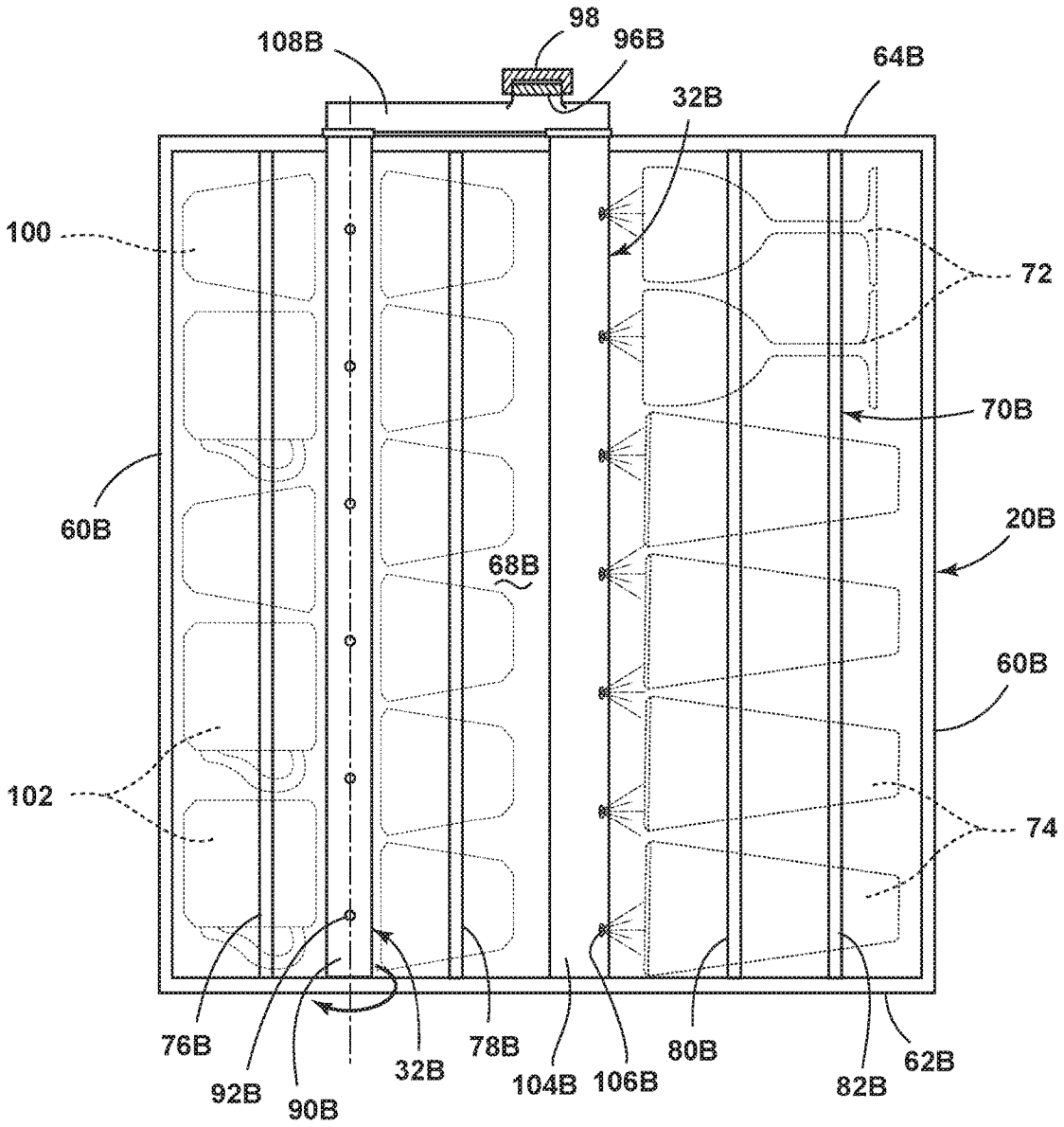
FIG. 6 is a schematic top view of a glasses dish rack according to another embodiment.

The glasses dish rack 20 may be modified to accommodate any type or arrangement of glasses. Such modifications may include, for example, employing multiple sprayers of the same type or different types and rearranging the glass supports and/or the sprayer(s). While numerous variations of the glasses dish rack 20 are feasible, exemplary alternative embodiments of the glasses dish rack are illustrated in FIGS. 5 and 6. In the following description of the alternative embodiments, elements similar to those of previous embodiments are identified with the same reference numeral bearing a letter, e.g., 20A, 20B, etc.

Referring to FIG. 5, the glasses dish rack 20A has been modified to hold a greater number of shorter glasses, shown by example as short tumblers 100 and mugs 102. The dish rack 20A is similar to the dish rack 20 of FIG. 4 and elements similar to those of previous embodiments are identified with the same reference numeral bearing a letter A, thus it will be understood that the dish rack 20A also includes a wire frame effectively forming opposing side walls 60A, a front wall 62A, a rear wall 64A, and a bottom wall 66A that together define an open-top glasses holding compartment 68A. The glasses 100, 102 are arranged in four rows, with each row supported by a corresponding one of the first, second, third, or fourth rows of glass supports 76A, 78A, 80A, 82A. The glass supports 70A are arranged to orient the glasses 100, 102 in an inclined position less than about 45 degrees relative to the horizontal, as in the previous embodiment. To accommodate the increased number of glasses, the rack spray assembly 32A of the dish rack 20A includes a second spray tube 104 in addition to the first spray tube 90A. The first spray tube 90A is located between the first and second rows of glasses to spray treating liquid into the glasses 100, 102 in these two rows, while the second spray tube 104 is positioned between the third and fourth rows of glasses to spray treating liquid into the glasses 100, 102 in these two rows. Each of the spray tubes 90A, 104 includes a single row of spray nozzles 92A, 106, and the spray tubes 90A, 104 may rotate about their respective longitudinal axes such that the spray nozzles 92A, 106 spray treating liquid into their adjacent rows of glasses alternately. By rotating the spray tubes 90A, 104, the treating fluid may be sprayed in multiple spray angles and trajectories. Optionally, the spray tubes 90A, 104 may include a plurality of rows of the spray nozzles 92A, 106, or the spray nozzles 92A, 106 may have an arrangement other than in rows. Alternatively, the spray tubes 90A, 104 may be stationary with multiple sets of spray nozzles, as in the previous embodiment, or another type of sprayer. The spray tubes 90A, 104 may be fluidly coupled by a manifold 108 that includes the connector 96A for docking with the receiver 98 in the tub 14. Alternatively, each of the spray tubes 90A, 104 may independently dock with a corresponding receiver in the tub.

Referring now to FIG. 6, a glasses dish rack 20B and a rack spray assembly 32B are shown, the glasses dish rack 20B is a hybrid of the glasses dish rack 20 of FIG. 4 and the glasses dish rack 20A of FIG. 5. The elements similar to those of previous embodimets are identified with the same reference numeral bearing a letter B, thus it will be understood that the dish rack 20A also includes a wire frame effectively forming opposing side walls 60B, a front wall 62B, a rear wall 64B, and a bottom wall 66B that together define an open-top glasses holding compartment 68B. Glass supports 70B are arranged such that are arranged in four rows, with each row supported by a corresponding one of the first, second, third, or forth rows of glass supports 76B, 78B, 80B, 82B. The left side of the glasses dish rack 20B is essentially identical to the left side of the glasses dish rack 20A in that it has two rows of the shorter glasses, i.e., the short tumblers 100 and the mugs 102, with the rotating spray tube 90B therebetween. The right side of the glasses dish rack 20B is essentially identical to the right side of the glasses dish rack 20, with a single row of the taller glasses, i.e., the wine glasses 72 and the tall tumblers 74, and the stationary spray tube 104 oriented to spray treating liquid into that row. The spray tubes 90B, 104B may be fluidly coupled by the manifold 108B that includes the connector 96B for docking with the receiver 98 in the tub. Alternatively, each of the spray tubes 90B (having nozzles 92B), 104B (having spray nozzles 106B) may independently dock with a corresponding receiver in the tub.

Figure 7:
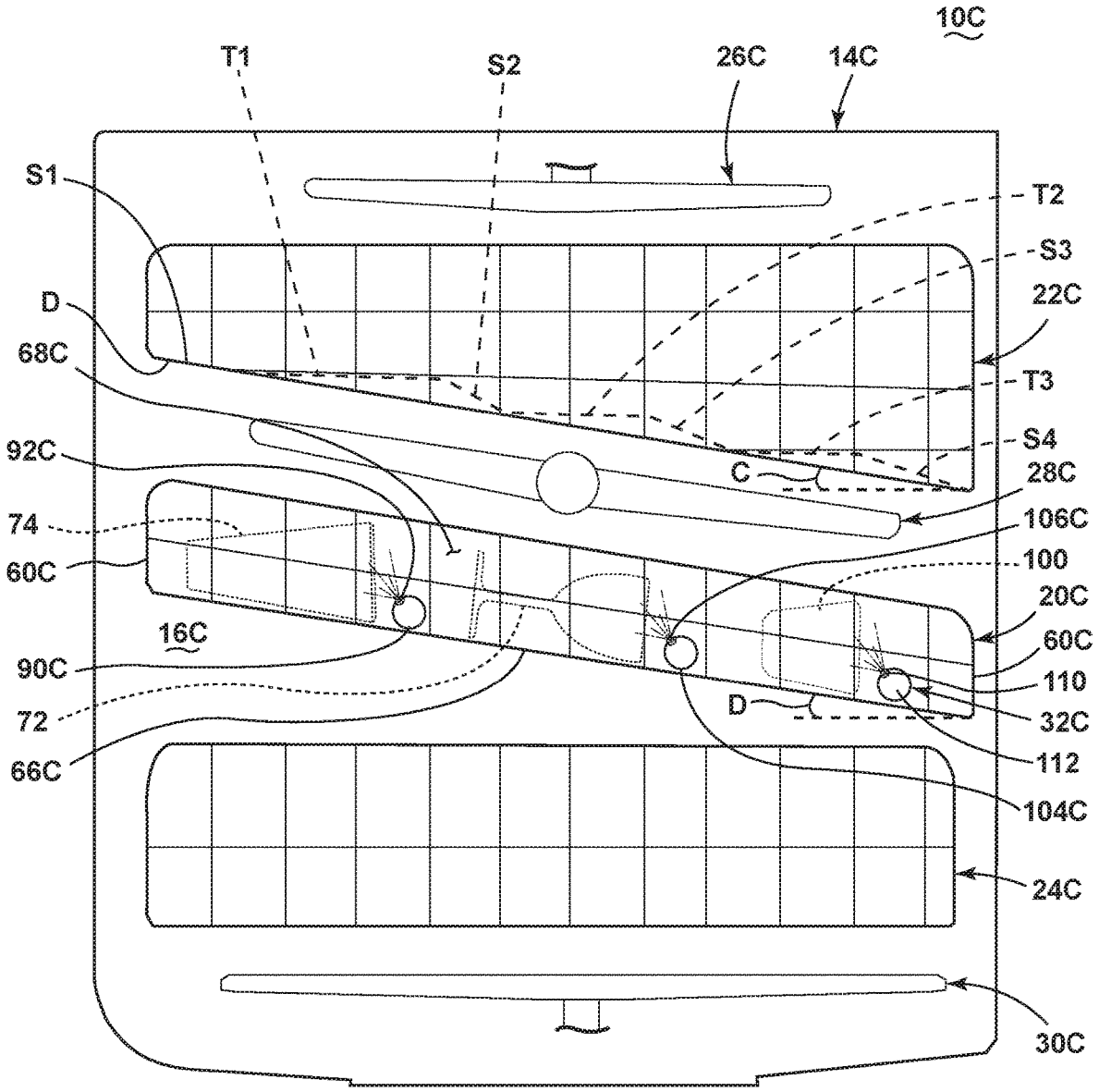
FIG. 7 is a schematic front view of a dishwasher tub with a glasses dish rack according to another embodiment for use below a tiered dish rack.

The glasses dish rack may also be modified for use below a tiered dish rack. As shown in the alternative embodiment in FIG. 7, a tiered dish rack 22C may be positioned as the uppermost rack in the tub 14C of dishwasher 10C. FIG. 7 schematically shows the bottom wall of the tiered dish rack 22C as a diagonal line D, while in reality, the bottom wall may include multiple tiers, each having a generally horizontal bottom wall, at differing vertical heights, as in a stepped configuration. An exemplary tiered dish rack is set forth in U.S. Pat. No. 8,287,660, issued Oct. 16, 2012, which is incorporated herein by reference in its entirety. Exemplary tiers have been schematically illustrated in phantom line slightly offset from the diagonal line and labeled as a first tier T1, a second tier T2, and a third tier T3. Corresponding sloped portions have also been labeled for completeness as a first sloped portion S1, a second sloped portion S2, a third sloped portion S3, and a fourth sloped portion S4. Nonetheless, the multiple steps of the tiered bottom wall define an effective inclination with an angle C relative to the horizontal for the tiered dish rack 22C, which is represented by the diagonal line D at the bottom of the tiered dish rack 22C in the schematic FIG. 7. A lowermost dish rack 24C, upper spray assembly 26C, middle spray assembly 28C, and the lower spray assembly 30C can also be included in the dishwater 10C.

The glasses dish rack 20C located below the tiered dish rack 22C, particularly the bottom wall 66C, may be inclined at an angle D relative to the horizontal from one of the side walls 60C to the opposite side wall 60C, and the angle D of the inclination may be near to or match the inclination angle C of the tiered dish rack 22C. Exemplary inclination angles for the angle D may be less than about 45 degrees, such as within a range of about 10 to 40 degrees. In one embodiment the angle D may be about 15 degrees. Additionally, the inclination angle of the glasses dish rack 22C may advantageously correspond to a desired inclination of the glasses, such as the exemplary illustrated glasses 72, 74, 100 in FIG. 7, such that glass supports or other structures may not be needed to support the glasses in the desired position; the glasses may rest on the bottom wall 66C of the dish rack 20C. Because the glasses can be positioned closer to and possibly even flat with the bottom wall 66C when the bottom wall 66C itself is inclined, the overall height of the glasses dish rack 20C and any portion of the glasses that may extend above the glasses dish rack 20C, of which there is none in the illustrated embodiment, may be reduced. Glass supports or other structures may still be employed to prevent the glasses from rolling and/or sliding in the glasses dish rack 20C, if desired. Further, while any suitable configuration of the rack spray assembly 32C may be employed, because the glasses must be facing the same direction, i.e., downward, so that the treating liquid will flow out of the glasses, each row of the glasses may have its own dedicated spray tube. For example, a first row of the glasses, represented by the tall tumbler 74, may receive liquid from the spray nozzles 92C on the spray tube 90C, a second row of the glasses, represented by the wine glass 72, may receive liquid from the spray nozzles 106C on the spray tube 104C, and a third row of the glasses, represented by the short tumbler 100, may receive liquid from spray nozzles 110 on a spray tube 112.

Figure 8:
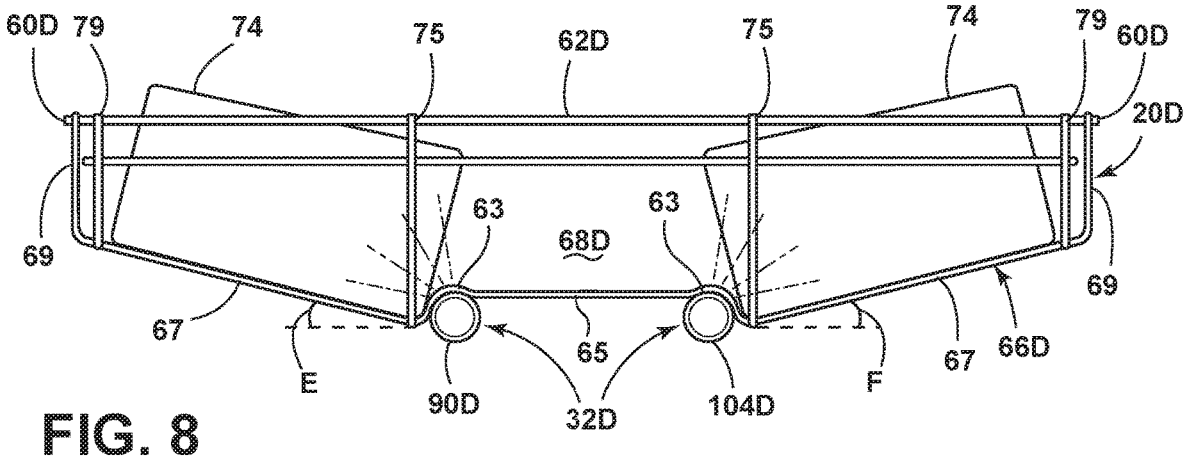
FIG. 8 is a schematic front view of a dish rack according to another embodiment.
Figure 9:
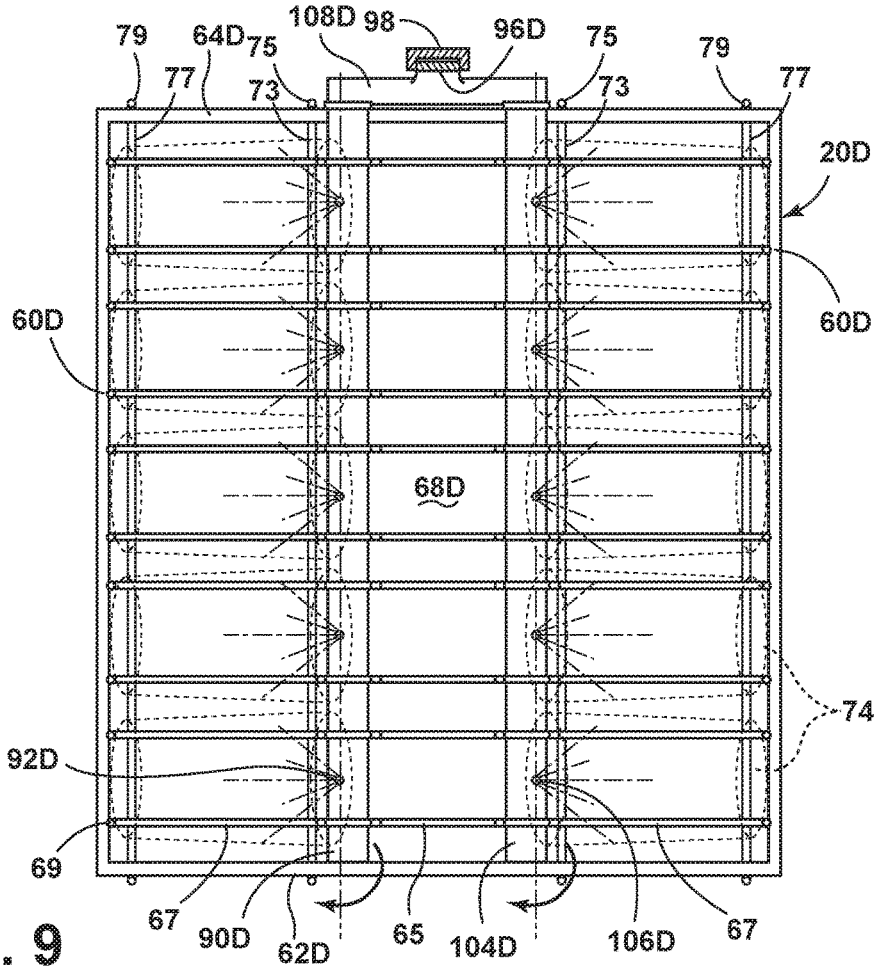
FIG. 9 is a schematic top view of the dish rack of FIG. 8.

Referring now to FIG. 8, the dish rack 20D is a modified hybrid version of the glasses dish rack 20 of FIGS. 3 and 4 and the glasses dish rack 20A of FIG. 5. The dish rack 20D has been modified to include a contoured bottom wall 66D. The dish rack 20D is constructed of a wire frame effectively forming an upper perimeter wall having opposing side walls 60D, a front wall 62D (FIG. 9), a rear wall 64D (FIG. 9), and a plurality of bottom walls 66D that together define an open-top glasses holding compartment 68D. The bottom walls 66D may be contoured, as illustrated by example, to form a curved spray tube mounting portions 63, flat central portions 65, opposing inclined portions 67 and opposing upstanding portions 69. The opposing upstanding portions 69 attach to the opposing side walls 60D to rigidly support the upper perimeter wall. Additionally, a plurality of upstanding wire supports 75, 79, may extend upwardly from the bottom walls 66D and attach to the front wall 62D (FIG. 9) and rear wall 64D (FIG. 9). Furthermore, lateral wire supports 73, 77 (FIG. 9) may extend between corresponding upstanding wire supports 75, 79, transverse to the bottom walls 66D and attach to the bottom walls 66D to provide additional rigidity to the wire frame of the dish rack 20D.

The opposing inclined portions 67 may be configured to position the glasses 74 at angles E, F less than about 45 degrees relative to the horizontal. In this embodiment, the horizontal is about coincident with the lateral wire supports 73, 77 of the dish rack 20D. The angle E, F may be defined as the angle between the inclined portions 67 and horizontal or the side wall of the glass and horizontal. If the side wall of the glass is curved, then the angle may be defined as the angle between a line tangent to the glass side wall and the horizontal. The particular angles E, F at which the glasses 74 are inclined, which may be equal or not equal, are a compromise between (1) the overall height of the dish rack 20D and the portion of the glasses 74 extending above the dish rack 20D and (2) suitable draining of liquid from the interior and exterior surfaces of the glasses 74. As the angles E, F increase to improve draining, the overall height increases, thereby consuming more valuable space within the tub. On the other hand, as the angles E, F decrease to reduce height and minimize the space required within the tub, draining performance may decrease. Exemplary preferred glass inclination angles range from about 5 to 45 degrees, with a preferred angle being about 15 degrees. The preferred inclination angle may vary for different types of glasses as the draining behavior may differ due to inherent structural differences, such as the contour and inclination of the side wall of the glasses.

The opposing inclined portions 67 may form a cradle for each of the glasses 74 to retain the glasses 74 in a particular location and prevent the glasses 74 from rolling within the dish rack 20D, as seen in FIG. 9, where the plurality of opposing inclined portions 67 are spaced apart to allow the glasses 74 to rest on two adjacent inclined portions 67 in order to prevent the glasses 74 from rolling. Furthermore, the glasses 74 may abut the curved spray tube mount portions 63 (FIG. 8) to prevent the glasses 74 from sliding down the inclined portions 67. The dish rack 20D may be configured to hold multiple rows of glasses 74, and the illustrated embodiment includes a first row of multiple glasses 74 supported by the plurality of one side of the opposing inclined portions 67 and a second row of multiple glasses 74 supported by the plurality of the other side of the opposing inclined portions 67. The inclined portions 67 may be configured to best hold a specific type of glass, such as the wine glasses in the first row, or may be configured to more generically hold multiple types of glasses, such as the wine glasses and the tall tumblers in the second row. The glass rack 20D may further be configured to automatically pivot each glass to a desired position.

The flat central portions 65 provide an area between the first and second rows defined by the inclined portions 67 to define a third row to provide a location to place additional items to be cleaned such as glasses, cutlery, cooking utensils, dishes, plates, pots, bowls, pans, lids, containers, glassware, and silverware. The items to be cleaned in the third row are supported by the adjacent flat central portions 65 of the bottom walls 66D. The rack can also be used to wash items other than glasses by placing the items on surfaces 67.

Optionally, the dish rack 20D may be equipped with the rack spray assembly 32D adapted to provide treating liquid to the interior of the glasses 74. The rack spray assembly 32D may include a first spray tube 90D and a second spray tube 104D (having spray nozzles 106D) similar to the spray assembly 32A illustrated in FIG. 5. The first and second spray tubes 90D, 104D are located under the curved spray tube mounting portion 63 (FIG. 8) on opposing sides of the flat central portions 65 between first and second rows of glasses to spray treating liquid into the glasses 74 in these two rows. Each of the spray tubes 90D, 104D includes a single row of spray nozzles 92A, 106D, and the spray tubes 90D, 104D may rotate about their respective longitudinal axes such that the spray nozzles 92D, 104D may spray treating liquid in the direction of the flat central portions 65. By rotating the spray tubes 90D, 104D, the treating fluid may be sprayed in multiple spray angles and trajectories. Optionally, the spray tubes 90D, 104D may include a plurality of rows of the spray nozzles 92D, 106D, or the spray nozzles 92D, 106D may have an arrangement other than in rows. Alternatively, the spray tubes 90D, 104D may be stationary with multiple sets of spray nozzles, as in the previous embodiment, or another type of sprayer. The spray tubes 90D, 104D may be fluidly coupled by a manifold 108D that includes the connector 96D for docking with the receiver 98 in the tub. Alternatively, each of the spray tubes 90D, 104D may independently dock with a corresponding receiver in the tub.

The dish rack 20 according to the different embodiments of the invention may be modified to accommodate any type or arrangement of glasses. Such modifications may include, for example, employing multiple sprayers of the same type or different types and rearranging the glass supports and/or the sprayer(s). While numerous variations of the glasses dish rack 20 are feasible, exemplary alternative embodiments of the glasses dish rack are illustrated in FIGS. 5, 6, 8 and 9. In the following description of the alternative embodiments, elements similar to those of previous embodiments are identified with the same reference numeral bearing a letter, e.g., 20A, 20B, etc.

Other modifications may be made to the glasses dish rack and to the arrangement of the glasses dish rack 20 in the dishwasher 10. For example, the glasses dish rack 20 may be arranged at the uppermost position in the dishwasher tub 14, as shown in FIG. 1, or in other positions, examples of which include below the uppermost dish rack (i.e., as a middle dish rack) and as the lowermost dish rack. Additionally, more than one of the glasses dish rack 20 may be arranged in the tub 14. For example, one or more of the conventional dish racks 22, 24 may be removed and replaced with multiple glasses dish racks 20 in a stacked configuration. The dishwasher 10 may be equipped with the appropriate structure (e.g., multiple receivers 98) to allow a user to swap one or more of the conventional dish racks 22, 24 for multiple glasses dish racks 20 when desired, such as when the user has a large amount of glasses to treat compared to other dishes commonly placed in the conventional dish racks 22, 24. In such a construction, the receivers that are not used when the conventional dish racks 22, 24 are employed can be configured to selectively close when not coupled with the rack spray assembly 32. When multiple glasses racks 20 are used with one of the conventional dish racks 22, 24 at the same time, the multiple glasses racks 20 may be stacked above or below the one of the conventional dish racks 22, 24. If the dishwasher is sufficiently tall, multiple glasses racks 20 may be used in combination with multiple conventional dish racks, and numerous configurations of the dish racks are feasible.

In another embodiment, the glasses dish rack 20 may include an air dispenser operably coupled with the air supply system so as to deliver heated or non-heated air to the glasses for drying and/or cooling the glasses. The air dispenser may be a tube with nozzles, similar to the exemplary rack spray assemblies described above, or may have any other suitable configuration. Optionally, air may be supplied through the spray system, either through the same conduits and nozzles that supply liquid or through additional conduits and nozzles integrated with the spray system. Further, the air dispenser may be mounted to the glasses dish rack 20 for movement therewith and dock with appropriate components of the air supply system when the glasses dish rack 20 is in its most rearward position in the tub 14, or the air dispenser may be mounted to tub 14. If the glasses dish rack 20 includes the air dispenser, then the glasses 72, 74 may be oriented at an angle closer to the horizontal, at the horizontal, or possibly even below the horizontal because gravity flow of the liquid from the glasses 72, 74 is no longer required or at least would not be the only mechanism for drying the glasses 72, 74.

The rack spray assembly 32 has been shown and described as having stationary and rotating spray tubes with spray nozzles, and other numbers of spray tubes, such as up to five spray tubes, or other types of sprayers are acceptable for use with the rack spray assembly 32. Examples of other types of sprayers include, but are not limited to, rotating spray arms, individual spray nozzles, stationary spray heads with multiple spray nozzles, spray discs, flexible spray tubes, translating front to back sprayers, etc.

The glasses dish rack 20 may also be modified to hold other types of dishes, such as utensils. As an example, the glasses dish rack 20 may be configured by the user, depending on the user's needs, to hold glasses only, glasses and utensils or other types of dishes, or only utensils and other types of dishes. Further, the glass supports 70 and/or other supporting structure may be modular and/or replaceable such that the user can configure the glasses dish rack 20 to hold a particular type of glasses, if desired. The glass supports 70 and/or other supporting structure may be removable and replaced with alternative glass supports and/or other supporting structure, and the glass supports 70 and/or other supporting structure may be converted to an alternative configuration.

While the invention has been specifically described in connection with certain specific embodiments thereof, it is to be understood that this is by way of illustration and not of limitation, and the scope of the appended claims should be construed as broadly as the prior art will permit.

What is claimed is:

1. A dishwasher, comprising:

a tub defining a treating chamber receiving dishes for treatment;

a spray system providing treating liquid to the treating chamber;

a first dish rack located in the tub and having a bottom wall tiered to form multiple levels, the bottom wall tiered to form multiple levels defining an effective inclination angle for the bottom wall of the first dish rack; and a second dish rack located below the first dish rack, the second dish rack having a non-tiered, flat bottom wall that is inclined at an angle from a first side wall to an opposite side wall, wherein the angle matches the effective inclination angle for the bottom wall of the first dish rack and is parallel to the effective inclination angle for the bottom wall of the first dish rack.

2. The dishwasher according to claim 1 wherein the angle of the non-tiered, flat bottom wall of the second dish rack is configured to hold glasses at an incline angled less than about 45 degrees relative to horizontal.

3. The dishwasher according to claim 2 wherein the spray system comprises a sprayer mounted to the second dish rack and positioned to spray treating liquid into an interior of the glasses.

4. The dishwasher according to claim 3 wherein the second dish rack is slidably mounted to the tub, the spray system further comprises a supply conduit located in the tub, and the sprayer selectively docks with the supply conduit during sliding movement of the second dish rack.

5. The dishwasher according to claim 2 wherein the angle of the non-tiered, flat bottom wall of the second dish rack is configured to hold glasses at an inclined angle of about 15 degrees.

6. The dishwasher according to claim 1 wherein an upper edge of the second dish rack is inclined at a second angle matching the effective inclination angle.

7. The dishwasher according to claim 6, further comprising a third dish rack located below the second dish rack.

8. The dishwasher according to claim 7 wherein the spray system comprises a first sprayer above the first dish rack, a second sprayer between the first and second dish racks, and a third sprayer below the third dish rack.

9. The dishwasher according to claim 7 wherein the third dish rack has a bottom wall and a side wall terminating in an upper edge.

10. The dishwasher according to claim 8 wherein at least one of the bottom wall or upper edge of the third dish rack is horizontal.

11. The dishwasher of claim 1 wherein the spray system comprises a plurality of spray tubes positioned to spray treating liquid into an interior of the second dish rack.

12. The dishwasher of claim 11 wherein the non-tiered, flat bottom wall of the second dish rack is configured to accommodate separate rows glasses, each of the separate rows of glasses corresponding to one of the plurality of spray tubes.

13. A dishwasher, comprising:

a tub defining a treating chamber receiving dishes for treatment;

a spray system providing treating liquid to the treating chamber; and a dish rack located in the tub and selectively moveable between a loading position, where at least a portion of the dish rack extends exteriorly of the tub, and a treating position where the dish rack is located entirely within the treating chamber and having a bottom wall, a side wall extending upwardly from the bottom wall and terminating in an upper edge, the bottom wall including a flat central portion, curved mounting portions at opposing ends of the flat central portion and opposing inclined portions, each of the opposing inclined portions extending from one of the curved mounting portions to respective portions of the side wall, the opposing inclined portions configured to support a side wall of a glass; and a spray tube having nozzles configured to emit spray along each of the opposing inclined portions into an interior of the glass, the spray tube located directly adjacent to one of the curved mounting portions of the bottom wall and carried with the dish rack between the loading position and the treating position.

14. The dishwasher of claim 13 wherein the spray tube is configured to rotate about a longitudinal axis.

15. The dishwasher of claim 13 wherein the flat central portion is located above a terminal end of at least one of the opposing inclined portions.

16. The dishwasher of claim 13, further comprising a second spray tube configured to emit spray along an other of the inclined portions, the second spray tube located directly adjacent to an other of the curved mounting portions of the bottom wall and carried with the dish rack between the loading position and the treating position.

17. A dishwasher, comprising:

a tub defining a treating chamber receiving dishes for treatment;

a spray system providing treating liquid to the treating chamber; and a dish rack located in the tub and selectively moveable into and out of the tub, the dish rack having a bottom wall, a side wall extending upwardly from the bottom wall and terminating in an upper edge, with an upwardly angled portion formed in the bottom wall comprising a plurality of spaced apart inclined portions forming the bottom wall and terminating at the side wall, wherein two adjacent inclined portions of the plurality of spaced apart inclined portions are configured to cradle a glass at an inclined angle and prevent the glass from rolling and a contoured portion formed in the bottom wall configured to prevent glasses from sliding down the inclined angle; and a spray tube having nozzles emitting spray along the angled portion;

wherein the contoured portion is further configured to form a curved mounting portion adjacent which the spray tube is mounted such that the spray tube is carried with the dish rack.

18. The dishwasher of claim 17 wherein the dish rack is a low profile dish rack where the length of the angled portion is greater than a shortest height of an upstanding portion of the side wall.

19. The dishwasher of claim 18 wherein at least one of the nozzles is located above a portion of the angled portion.

20. The dishwasher of claim 18 wherein the shortest height is located along a portion of the side wall transverse to the angled portion.

21. The dishwasher of claim 17 wherein at least one of the nozzles is located above a portion of the angled portion.

* * * * *